US007793371B1

(12) United States Patent
Leach

(10) Patent No.: US 7,793,371 B1
(45) Date of Patent: Sep. 14, 2010

(54) APPARATUS AND METHOD FOR QUESTION MARK-SHAPED BODY PILLOW AND SUPPORT SYSTEM

(76) Inventor: Jamie S. Leach, P.O. Box 717, 130 E. 10th St., Ada, OK (US) 74821

( * ) Notice: Subject to any disclaimer, the term of this patent is extended or adjusted under 35 U.S.C. 154(b) by 0 days.

(21) Appl. No.: 11/511,160

(22) Filed: Aug. 28, 2006

(51) Int. Cl.
*A47C 20/00* (2006.01)
*A47C 16/00* (2006.01)
*B68G 5/00* (2006.01)

(52) U.S. Cl. ..... 5/632; 5/633; 5/655; 5/630; 5/652

(58) Field of Classification Search ..... 5/632, 5/633, 655
See application file for complete search history.

(56) References Cited

U.S. PATENT DOCUMENTS

| | | | |
|---|---|---|---|
| 395,043 | A | 12/1888 | Doremus |
| 416,970 | A | 12/1889 | Taylor |
| 726,164 | A | 4/1903 | Hogan et al. |
| 909,453 | A | 1/1909 | Pullman |
| 1,376,625 | A | 5/1921 | Johnston |
| 1,447,288 | A | 3/1923 | Emmerich |
| 1,577,586 | A | 3/1926 | Morehouse |
| 1,769,722 | A | 7/1930 | Sutton |
| 2,149,140 | A | 2/1939 | Gonzalez-Rincones |
| D124,296 | S | 12/1940 | Thompson |
| 2,279,867 | A | 4/1942 | Falk |
| 2,328,871 | A | 9/1943 | Woehler |
| 2,336,707 | A | 12/1943 | Thompson |
| 2,404,108 | A | 7/1946 | Stauffacher et al. |
| 2,404,505 | A | 7/1946 | Knecht |
| 2,429,350 | A | 10/1947 | Farrand |
| 2,451,007 | A | 10/1948 | White |
| 2,495,482 | A | 1/1950 | Rogatz |
| 2,502,486 | A | 4/1950 | Savrin |
| 2,544,896 | A | 3/1951 | Nidetch et al. |
| D162,858 | S | 4/1951 | McGlinchey |
| 2,626,407 | A | 1/1953 | Kurry |

(Continued)

FOREIGN PATENT DOCUMENTS

JP 20041949989 7/2004

(Continued)

OTHER PUBLICATIONS

U.S. Appl. No. 11/193,195, filed Aug. 1, 2005, Leach.

(Continued)

*Primary Examiner*—Michael Trettel
*Assistant Examiner*—Jonathan J Liu
(74) *Attorney, Agent, or Firm*—Mary M. Lee

(57) ABSTRACT

This invention relates generally to a body pillow and support system. Due to the need for additional support, pregnant women often encounter difficulty sleeping. The support pregnant women typically need is not just for their head, but for their abdomen, back and/or legs. Many pregnant women find themselves hot or cold as well as hot on one part of their body and cold on a different part of their body. All of these conditions are usually met by the pregnant woman finding several pillows and stuffing those same pillows all around her when she is trying to get some rest. This invention also is useful for a diverse group of people who need soft support to rest or recuperate and is not limited to women who are pregnant.

25 Claims, 10 Drawing Sheets

U.S. PATENT DOCUMENTS

| | | | |
|---|---|---|---|
| 2,652,183 | A | 9/1953 | Hlivka |
| 2,694,202 | A | 11/1954 | Macrides |
| 2,694,204 | A | 11/1954 | Cross |
| 2,741,412 | A | 4/1956 | Hinkle |
| 2,795,802 | A | 6/1957 | Myers |
| 2,817,090 | A | 12/1957 | Toellner |
| 2,857,957 | A | 10/1958 | Gay |
| 2,880,424 | A | 4/1959 | Kalensky |
| D191,513 | S | 10/1961 | Kerr |
| 3,088,438 | A | 5/1963 | Oliphant |
| D201,492 | S | 6/1965 | Jacobson |
| 3,239,271 | A | 3/1966 | Bergersen |
| 3,298,035 | A | 1/1967 | Gobins |
| 3,327,330 | A | 6/1967 | McCullough |
| 3,392,737 | A | 7/1968 | Fefferman |
| 3,604,026 | A | 9/1971 | Scheips |
| 3,604,750 | A | 9/1971 | Doering |
| 3,671,977 | A | 6/1972 | Degnon |
| 3,713,692 | A | 1/1973 | McCracken et al. |
| D227,423 | S | 6/1973 | Ando |
| 3,773,287 | A | 11/1973 | Hechinger |
| D230,804 | S | 3/1974 | Lijewski |
| 3,840,916 | A | 10/1974 | Jennings |
| 3,848,281 | A | 11/1974 | Matthews |
| 3,899,210 | A | 8/1975 | Samhammer et al. |
| 3,899,797 | A | 8/1975 | Gunst |
| 3,911,512 | A | 10/1975 | Plate |
| D244,569 | S | 6/1977 | Laroye |
| 4,027,888 | A | 6/1977 | Wilcox |
| 4,031,567 | A | 6/1977 | Planck |
| 4,037,764 | A | 7/1977 | Almosnino et al. |
| 4,050,737 | A | 9/1977 | Jordan |
| 4,173,048 | A | 11/1979 | Varaney |
| 4,179,158 | A | 12/1979 | Flaum et al. |
| 4,194,254 | A | 3/1980 | Torrez |
| 4,197,604 | A | 4/1980 | Nakamura |
| 4,227,270 | A | 10/1980 | Rivera |
| 4,235,474 | A | 11/1980 | Rosenberg |
| 4,236,264 | A | 12/1980 | Britzman |
| D259,902 | S | 7/1981 | Rock |
| 4,287,542 | A | 9/1981 | Okuda |
| D265,027 | S | 6/1982 | Meyers |
| D266,800 | S | 11/1982 | Kula et al. |
| 4,383,713 | A | 5/1983 | Roston |
| 4,393,530 | A | 7/1983 | Stark |
| 4,428,514 | A | 1/1984 | Elf |
| 4,434,920 | A | 3/1984 | Moore |
| 4,506,396 | A | 3/1985 | Ritchie, Jr. et al. |
| 4,550,459 | A | 11/1985 | Endel et al. |
| 4,574,412 | A | 3/1986 | Smith |
| D284,220 | S | 6/1986 | Pote |
| 4,592,589 | A | 6/1986 | Hellwig |
| 4,606,078 | A | 8/1986 | Tkacsik |
| 4,606,087 | A | 8/1986 | Alivizatos |
| 4,624,021 | A | 11/1986 | Hofstetter |
| 4,654,907 | A | 4/1987 | Haugaard |
| 4,666,017 | A | 5/1987 | Zimmerman |
| 4,667,356 | A | 5/1987 | Holmquist |
| 4,667,624 | A | 5/1987 | Smith |
| 4,670,923 | A | 6/1987 | Gabriel et al. |
| 4,676,198 | A | 6/1987 | Murray |
| 4,676,554 | A | 6/1987 | Harlick et al. |
| 4,685,163 | A | 8/1987 | Quillen et al. |
| 4,698,862 | A | 10/1987 | Mairs |
| 4,709,430 | A | 12/1987 | Nicoll |
| 4,712,258 | A | 12/1987 | Eves |
| 4,731,890 | A | 3/1988 | Roberts |
| 4,754,509 | A | 7/1988 | Pollard |
| 4,754,510 | A | 7/1988 | King |
| 4,757,925 | A | 7/1988 | Knittel |
| 4,763,369 | A | 8/1988 | Spector |
| 4,788,726 | A | 12/1988 | Rafalko |
| 4,790,035 | A | 12/1988 | Whyte |
| 4,794,657 | A | 1/1989 | Avery |
| 4,796,315 | A | 1/1989 | Crew |
| D299,988 | S | 2/1989 | Parabita |
| 4,827,542 | A | 5/1989 | Kurtenbach |
| 4,834,459 | A | 5/1989 | Leach |
| 4,836,605 | A | 6/1989 | Greenwood et al. |
| 4,840,144 | A | 6/1989 | Voorhees et al. |
| 4,850,144 | A | 7/1989 | Grisham et al. |
| 4,853,994 | A | 8/1989 | Ekstein |
| 4,861,109 | A | 8/1989 | Leach |
| D303,897 | S | 10/1989 | Phillips |
| 4,871,210 | A | 10/1989 | Alexander et al. |
| 4,901,384 | A | 2/1990 | Eary |
| D306,948 | S | 4/1990 | Zollinger |
| D308,788 | S | 6/1990 | Boehm |
| D309,018 | S | 7/1990 | Leach |
| D310,609 | S | 9/1990 | Burkhardt |
| D313,141 | S | 12/1990 | Witter et al. |
| 4,980,937 | A | 1/1991 | Mason et al. |
| 4,986,458 | A | 1/1991 | Linday |
| 4,996,734 | A | 3/1991 | Rowe |
| 4,999,863 | A | 3/1991 | Kane |
| 4,999,866 | A | 3/1991 | Lindsey |
| 5,026,315 | A | 6/1991 | Chap |
| D318,202 | S | 7/1991 | Weber |
| 5,035,013 | A | 7/1991 | Bloom |
| D318,969 | S | 8/1991 | Byrn |
| 5,048,136 | A | 9/1991 | Popitz |
| 5,088,141 | A | 2/1992 | Meyer et al. |
| 5,097,551 | A | 3/1992 | Smith |
| 5,103,514 | A | 4/1992 | Leach |
| 5,109,557 | A | 5/1992 | Koy et al. |
| 5,115,524 | A | 5/1992 | Antosko |
| 5,119,767 | A | 6/1992 | Jimenez |
| 5,154,649 | A | 10/1992 | Pender |
| 5,159,727 | A | 11/1992 | McCracken |
| 5,165,130 | A | 11/1992 | Wendling |
| 5,178,309 | A | 1/1993 | Bicheler et al. |
| 5,179,741 | A | 1/1993 | Book |
| D332,865 | S | 2/1993 | Wilmink |
| 5,187,309 | A | 2/1993 | Esch et al. |
| 5,193,238 | A | 3/1993 | Clute |
| 5,216,772 | A | 6/1993 | Clute |
| D339,923 | S | 10/1993 | Clarke |
| 5,249,308 | A | 10/1993 | Blume |
| 5,261,134 | A | 11/1993 | Matthews |
| D342,615 | S | 12/1993 | Asher |
| 5,269,323 | A | 12/1993 | Krouskop |
| 5,272,780 | A | 12/1993 | Clute |
| 5,310,245 | A | 5/1994 | Lyszczasz |
| 5,325,818 | A | 7/1994 | Leach |
| 5,339,472 | A | 8/1994 | Yin |
| 5,341,531 | A | 8/1994 | Straub et al. |
| 5,346,278 | A | 9/1994 | Dehondt |
| 5,363,524 | A | 11/1994 | Lang |
| 5,365,613 | A | 11/1994 | Henegan |
| 5,371,909 | A | 12/1994 | McCarty |
| D355,306 | S | 2/1995 | Moses |
| 5,429,852 | A | 7/1995 | Quinn |
| 5,439,008 | A | 8/1995 | Bowman |
| D365,241 | S | 12/1995 | Braden et al. |
| 5,473,785 | A | 12/1995 | Lager et al. |
| D366,368 | S | 1/1996 | McCarthy |
| 5,490,528 | A | 2/1996 | Day |
| D369,054 | S | 4/1996 | Straub et al. |
| D369,934 | S | 5/1996 | Straub et al. |
| 5,519,906 | A | 5/1996 | Fanto-Chan |
| D370,585 | S | 6/1996 | Faithfull |
| 5,522,528 | A | 6/1996 | Petricola |
| 5,546,620 | A | 8/1996 | Matthews |
| 5,551,109 | A | 9/1996 | Tingley et al. |

| | | | |
|---|---|---|---|
| D375,557 | S | 11/1996 | Dixon |
| 5,570,823 | A | 11/1996 | Lindy |
| 5,572,753 | A | 11/1996 | Ruscitto |
| 5,581,833 | A | 12/1996 | Zenoff |
| 5,586,351 | A | 12/1996 | Ive |
| D377,423 | S | 1/1997 | Latrella et al. |
| D377,881 | S | 2/1997 | Watt |
| 5,621,919 | A | 4/1997 | Graham |
| 5,647,076 | A | 7/1997 | Gearhart |
| D381,790 | S | 8/1997 | Harris et al. |
| D382,435 | S | 8/1997 | Schaffner et al. |
| 5,661,861 | A | 9/1997 | Matthews |
| 5,664,271 | A | 9/1997 | Bellavance |
| 5,685,016 | A | 11/1997 | Douglas |
| 5,699,569 | A | 12/1997 | Schwarz-Zohrer |
| D388,589 | S | 1/1998 | Walker |
| 5,708,982 | A | 1/1998 | Armani |
| 5,778,470 | A | 7/1998 | Haider |
| 5,813,066 | A | 9/1998 | Gebhard et al. |
| 5,826,287 | A | 10/1998 | Tandrup |
| 5,839,138 | A | 11/1998 | Weidman et al. |
| 5,857,598 | A | 1/1999 | Dunne |
| D408,676 | S | 4/1999 | Straub et al. |
| D409,038 | S | 5/1999 | Rojas, Jr. et al. |
| D412,234 | S | 7/1999 | Cox |
| 5,930,854 | A | 8/1999 | O'Neill et al. |
| D413,751 | S | 9/1999 | Alyea |
| 5,946,725 | A | 9/1999 | Shatzkin et al. |
| 5,950,887 | A | 9/1999 | Powell |
| D414,915 | S | 10/1999 | Anderson |
| D416,745 | S | 11/1999 | Noyes |
| 5,978,990 | A | 11/1999 | Akey |
| 5,979,981 | A | 11/1999 | Dunne et al. |
| 5,987,674 | A | 11/1999 | Schaffner et al. |
| D419,819 | S | 2/2000 | Bartoli |
| D420,845 | S | 2/2000 | Rumage |
| 6,026,525 | A | 2/2000 | Davis |
| 6,038,720 | A | 3/2000 | Matthews et al. |
| 6,045,178 | A | 4/2000 | Miller |
| 6,049,929 | A | 4/2000 | Rawson |
| 6,052,848 | A | 4/2000 | Kelly |
| 6,055,687 | A | 5/2000 | Matthews |
| 6,061,854 | A | 5/2000 | Crowley |
| 6,065,655 | A | 5/2000 | Parewick |
| 6,079,067 | A | 6/2000 | Becker et al. |
| 6,088,854 | A | 7/2000 | Brownrigg |
| 6,112,960 | A | 9/2000 | Seering et al. |
| 6,119,873 | A | 9/2000 | Matthews |
| 6,123,389 | A | 9/2000 | O'Connor et al. |
| D431,745 | S | 10/2000 | Jackson |
| 6,141,805 | A | 11/2000 | Fisher-Cohen et al. |
| 6,141,807 | A | 11/2000 | Tapper |
| 6,205,600 | B1 | 3/2001 | Sedlack |
| 6,209,962 | B1 | 4/2001 | Sobel et al. |
| 6,212,717 | B1 | 4/2001 | Cooper |
| 6,213,362 | B1 | 4/2001 | Lorenzini et al. |
| D443,461 | S | 6/2001 | Hall et al. |
| D444,981 | S | 7/2001 | Hall et al. |
| D445,506 | S | 7/2001 | Vinson et al. |
| 6,253,400 | B1 * | 7/2001 | Rudt-Sturzenegger et al. . 5/655 |
| D446,675 | S | 8/2001 | Straub |
| 6,279,185 | B1 | 8/2001 | Matthews |
| D447,376 | S | 9/2001 | Kramer |
| D450,517 | S | 11/2001 | Darling et al. |
| D453,653 | S | 2/2002 | Tunnell |
| 6,343,727 | B1 | 2/2002 | Leach |
| 6,349,437 | B1 | 2/2002 | Horning |
| 6,354,665 | B1 | 3/2002 | Ross |
| 6,408,463 | B1 | 6/2002 | Palacio |
| 6,412,128 | B1 | 7/2002 | Matthews |
| 6,427,251 | B1 | 8/2002 | Leach |
| 6,434,769 | B1 | 8/2002 | Koenig |
| 6,434,770 | B2 | 8/2002 | Matthews Brown |
| 6,453,493 | B1 | 9/2002 | Matthews Brown |
| 6,457,195 | B1 | 10/2002 | Holste |
| 6,463,608 | B1 | 10/2002 | Moe |
| 6,484,337 | B1 | 11/2002 | Moe et al. |
| D467,117 | S | 12/2002 | Guy |
| 6,499,164 | B1 | 12/2002 | Leach |
| 6,499,165 | B1 | 12/2002 | Morgillo |
| 6,505,366 | B1 | 1/2003 | Lied |
| 6,532,612 | B2 | 3/2003 | Matthews Brown |
| 6,539,567 | B1 | 4/2003 | Bae |
| 6,553,590 | B1 | 4/2003 | Leach |
| 6,574,810 | B2 | 6/2003 | Mangiaracina |
| 6,601,252 | B1 | 8/2003 | Leach |
| 6,625,828 | B2 | 9/2003 | Matthews Brown |
| 6,640,977 | B2 | 11/2003 | Matthews Brown et al. |
| 6,658,681 | B2 | 12/2003 | Britto et al. |
| 6,662,390 | B1 | 12/2003 | Berger |
| 6,671,907 | B1 | 1/2004 | Zuberi |
| 6,671,908 | B2 | 1/2004 | Brown et al. |
| 6,685,024 | B1 | 2/2004 | Matthews |
| 6,692,072 | B2 | 2/2004 | Nelson et al. |
| 6,708,354 | B1 | 3/2004 | Carter et al. |
| 6,711,770 | B1 | 3/2004 | Owens et al. |
| 6,751,817 | B1 | 6/2004 | Leach |
| D492,533 | S | 7/2004 | Cole |
| 6,760,934 | B1 | 7/2004 | Leach |
| 6,763,539 | B1 | 7/2004 | Bartley et al. |
| D493,964 | S | 8/2004 | Low |
| 6,802,092 | B1 | 10/2004 | Klein |
| 6,814,405 | B2 | 11/2004 | Norman |
| 6,851,143 | B2 | 2/2005 | Matthews Brown |
| 6,857,150 | B2 | 2/2005 | Matthews Brown et al. |
| D503,063 | S | 3/2005 | Bartle et al. |
| 6,874,183 | B1 | 4/2005 | Taylor |
| 6,892,406 | B2 | 5/2005 | Littlehorn |
| 6,905,169 | B1 | 6/2005 | Donoghue |
| 6,920,655 | B2 | 7/2005 | Mitchell |
| 6,944,898 | B2 | 9/2005 | Matthews Brown et al. |
| 7,000,273 | B2 | 2/2006 | Rivera-Wienhold et al. |
| 7,000,274 | B2 | 2/2006 | Matthews Brown et al. |
| 7,000,275 | B2 | 2/2006 | Matthews Brown et al. |
| 7,000,766 | B2 | 2/2006 | Matthews Brown et al. |
| 7,010,821 | B1 | 3/2006 | Leach |
| 7,017,212 | B2 | 3/2006 | Matthews Brown |
| D518,989 | S | 4/2006 | Clapp |
| 7,055,196 | B2 | 6/2006 | Littlehorn |
| 7,089,639 | B2 | 8/2006 | Matthews Brown et al. |
| 7,114,206 | B2 | 10/2006 | Leach |
| 7,127,760 | B2 | 10/2006 | Bartley et al. |
| 7,131,156 | B1 | 11/2006 | Walker-Craft |
| 7,146,663 | B2 | 12/2006 | Brown et al. |
| 2002/0029422 | A1 | 3/2002 | Matthews |
| 2004/0060116 | A1 | 4/2004 | Matthews Brown |
| 2005/0210591 | A1 | 9/2005 | Mead et al. |
| 2006/0031992 | A1 | 2/2006 | Moore |
| 2007/0022526 | A1 | 2/2007 | Leach |
| 2007/0028384 | A1 | 2/2007 | Leach |
| 2007/0046084 | A1 | 3/2007 | Leach |
| 2007/0151031 | A1 | 7/2007 | Leach |

FOREIGN PATENT DOCUMENTS

WO PCT/US01/270768 A1 3/2002

OTHER PUBLICATIONS

U.S. Appl. No. 11/216,361, filed Aug. 31, 2005, Leach.
U.S. Appl. No. 11/324,387, filed Jan. 4, 2006, Leach.
U.S. Appl. No. 11/446,459, filed Jun. 5, 2006, Leach.
Abstract, JP 2004 194989, Jul. 15, 2004, ESPACENET.

* cited by examiner

APPARATUS AND METHOD FOR QUESTION MARK-SHAPED BODY PILLOW AND SUPPORT SYSTEM

BACKGROUND OF THE INVENTION

This invention relates generally to a body pillow and support system. Currently available pillows typically support one or two portions of the body. Additionally, common pillows are difficult to configure and do not retain a desired configuration after a user relaxes and falls asleep. As a result, support initially provided by manually manipulating a pillow is lost during sleep impeding the ability to achieve a restful sleep. In particular, pregnant women frequently encounter difficulty sleeping due to the need for additional support and poor air circulation around standard bedding. To compensate for conditions related to pregnancy, pregnant women frequently use several pillows to provide the necessary support and comfort when seeking rest. However, support obtained from using several pillows also increases the insulating effect of a person's body thereby increasing the overall feeling of being hot a person may experience.

To overcome these problems, the present invention provides a "body pillow" which assists pregnant women and others requiring additional support to obtain rest and sleep. The pillow, which acts as a support system throughout pregnancy, is particularly useful during the second and third trimesters of a pregnancy. In addition to providing support for the user's head, abdomen, back and legs, the current invention also provides improved air circulation about the user's body providing reduced thermal loading on the body while continuing to provide support. One significant benefit of the present invention for a pregnant woman is the support for her legs and abdomen while providing a ventilation area between her legs. Further, the unique shape of the invention and its versatility make it an ideal candidate for numerous other uses including, but not limited to, use by children, obese people, elderly people needing support or less painful means of resting, osteoporosis patients, groin or rectal area surgery patients and people suffering from respiratory illnesses requiring them to sleep upright or in a reclined position.

SUMMARY OF THE INVENTION

The body pillow and body support system of present invention comprises a pillow having the general configuration of a question mark. In one preferred embodiment, the current invention provides a pillow comprising a curved head segment having a radius of curvature in a first direction. Additionally, the pillow includes a generally straight lower segment joined to the curved head segment by a transitional segment. The transitional segment has a radius of curvature in a second direction. Additionally, the curved head segment preferably carries a terminal end having a radius of curvature in the first direction which is smaller than the radius of curvature of said curved head. Further, the terminal end preferably carries at least one tab adapted to secure said terminal end to the generally straight lower end, the curved head segment or the transitional segment.

In another embodiment, the current invention provides a pillow, comprising a curved head segment having a radius of curvature in a first direction. The curved head segment is joined to a lower segment by a transitional segment. The transitional segment has a radius of curvature in a second direction. Additionally, the lower segment carries an inner contour and outer contour on its inner and outer perimeters. Preferably, the inner contour is generally centrally located on the inner perimeter of the lower segment and the outer contour is located on the lower one-third of said lower segment.

In another embodiment, the current invention provides a pillow, comprising a curved head segment having a radius of curvature in a first direction. Preferably, the curved head segment terminates with a terminal segment having a radius of curvature smaller than the radius of curvature of the head. The curved head segment is joined to a lower segment by a transitional segment. The transitional segment has a radius of curvature in a second direction. Additionally, the lower segment carries an inner contour and outer contour on its inner and outer perimeters. Preferably, the inner contour is generally centrally located on the inner perimeter of the lower segment and the outer contour is located on the lower one-third of said lower segment. The pillow further comprises a form fitted cover carrying at least one pocket and at least one tab suitable for securing the terminal segment of the curved head to the transitional segment or lower segment of the pillow. When not in use, the tab is storable in the pocket.

In a preferred method of use, a circle is formed by attaching the tab(s) of the pillow around the lower segment or the transitional segment of the pillow. This circle is a well of variable size, depending on the position of the tab(s). The tab(s) may be positioned at one of several locations on the body of the pillow, but it is anticipated that the tab(s) will be predominately positioned about the transitional segment of the pillow or the lower segment of the pillow. The size of the circle is adjusted by moving the tab(s) along the length of the lower segment or the transitional segment of the pillow. Placing the tab(s) higher the along the lower segment on into the transitional segment, the tighter the circle that is formed. Once a circle is formed, usage of the pillow is varied and only limited by the imagination of the person using it, but several unique and specific uses are described herein.

BRIEF DESCRIPTION OF THE DRAWINGS

FIG. 6—Top view of the invention depicting a person using the pillow for leg support, leg ventilation and abdominal support when the pillow is configured for a small circle.

DETAILED DESCRIPTION OF THE PREFERRED EMBODIMENTS

Figure 1:
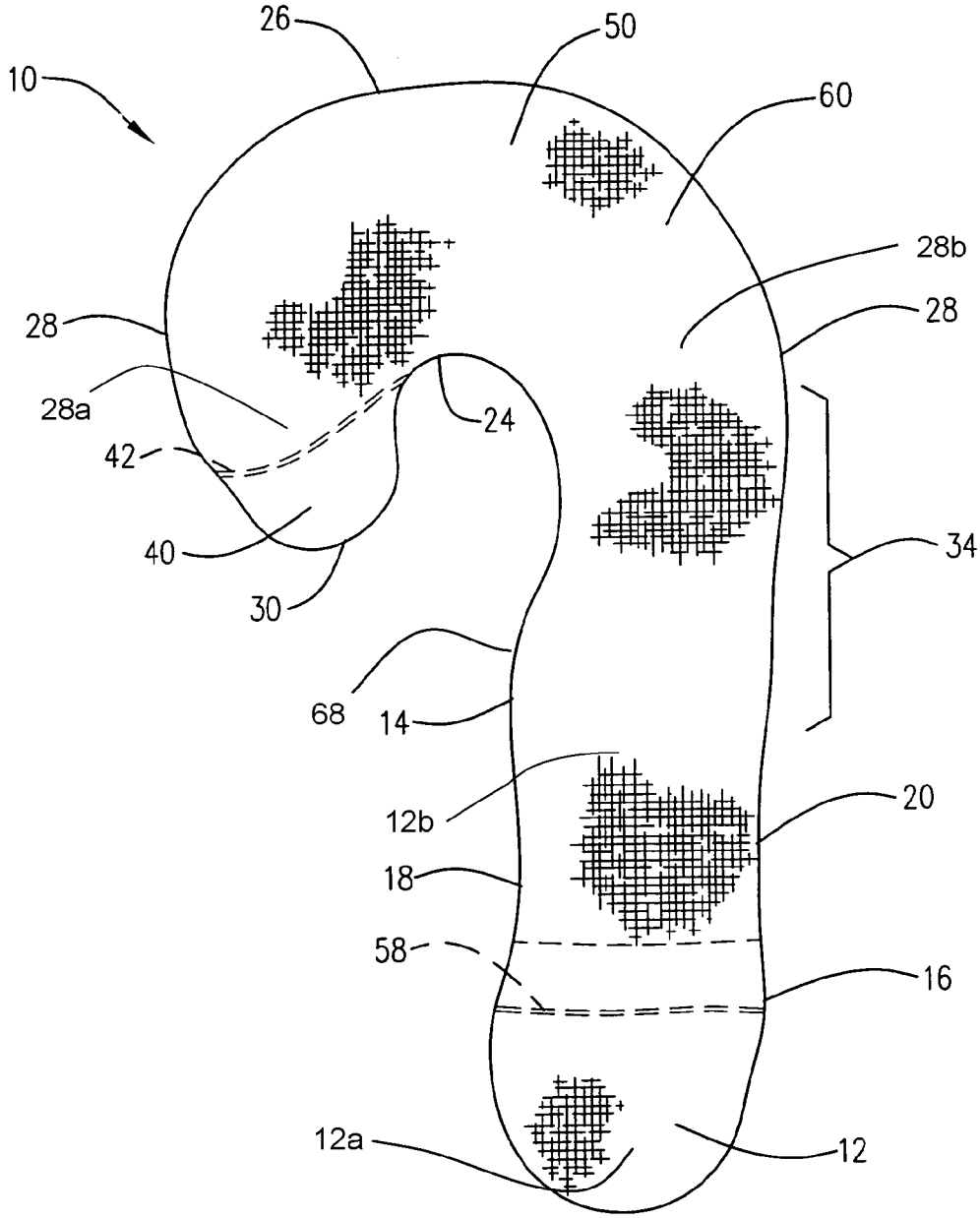
FIG. 1—Front view of invention with tab in a stowed position.

As depicted in FIG. 1, a preferred embodiment of the current invention provides a full body pillow 10 including a removable or permanently fixed pillow cover 50. Pillow 10 and cover 50 have the general configuration of a question mark. FIG. 1 depicts a view of a front side 60 of pillow 10. The unique configuration of pillow 10 provides support for both the front and the back of the user's body. The support is provided by the combination of several elements that include a lower segment 12 of the question mark shape, inner and outer contours 14, 16 located respectively on the inner and outer perimeters 18, 20 of lower segment 12, inner and outer radii 24, 26 of a generally C-shaped circle segment 28, and the optional but preferred terminal segment 30 (or upper end). The circle segment 28 includes a terminal end 28*a* and a nonterminal end 28*b*, the terminal segment 30 extending from the terminal end. The lower segment 12 has a terminal end (or lower end) 12*a* and a nonterminal end 12*b*. As shown in FIG. 1, lower segment 12 and circle segment 28 are joined by transitional segment 34 joining the nonterminal end 12*b* of the lower segment to the nonterminal end 28*b* of the circle segment. Thus, the lower segment 12 and the transitional segment 34 form an elongate body 68 extending from the nonterminal end 28*b* of the circle segment 28.

Pillow 10 is capable of being manipulated or configured into different shapes. When used as a body pillow, the generally question mark configuration provides support to the head and neck regardless of whether the user is facing segments 12 and 34 of pillow 10 or facing away from segments 12 and 34. Depending upon which way the person is facing, the opposite side of the body is also supported by either the circle segment 28 or segments 12 and 34.

Inner contour 14 is designed to be a functional protrusion along inner perimeter 18. Outer contour 16 is designed to be a functional protrusion along outer perimeter 20. Inner contour 14 is formed by sewing a protruding variation in the seam (not shown) of inner perimeter 18 seam wherein the smooth nature of inner perimeter 18 is changed to force a portion of pillow 10 to form inner contour 14. Techniques for forming inner contour 14 are well known to those skilled in the art. Inner contour 14 functions as a support device to the user of pillow 10 in most of the configurations for use described herein. The main function of inner contour 14 is for inner contour 14 to be positioned under part of the body of the user to provide support. This action forces the body to rotate the opposite direction from inner contour 14 while providing support to the particular body part of the user. In the preferred embodiment, a pregnant woman would have her abdominal area supported by inner contour 14 which lifts and supports the abdominal area thereby reducing pressure on other parts of her body such as her back. Inner contour 14 may be located on lower segment 12, transitional segment 34 or may extend over portions of both segments 12 and 34. In the preferred embodiment, inner contour 14 is located on segment 12 near transitional segment 34. Outer contour 16 is formed similarly to inner contour 14 except that outer contour 16 is placed lower on lower segment 12 along outer perimeter 20. Preferably, outer contour 16 is on the lower one-third of lower segment 12. Outer contour 16 provides similar support to the body as inner contour 14. However, outer contour 16 optionally functions as an attachment point for tab(s) 36 when forming large circle 44.

In general, a person facing segments 12 and 34 will place their lower arm under pillow 10. When used in this manner, terminal segment 30 pushes into the upper back of the user providing back support while segments 12, 28 and 34 provide front torso and head support. Additionally, inner contour 14 located on inner perimeter 18 of pillow 10 typically extends through the abdominal region of the user. Thus, inner perimeter 18 tucks under the abdomen providing gentle support reducing fatigue and undue strain. Lower segment 12 is available to be tucked between the user's legs or knees providing additional support for the individual and permitting air circulation between the legs.

Figure 3:
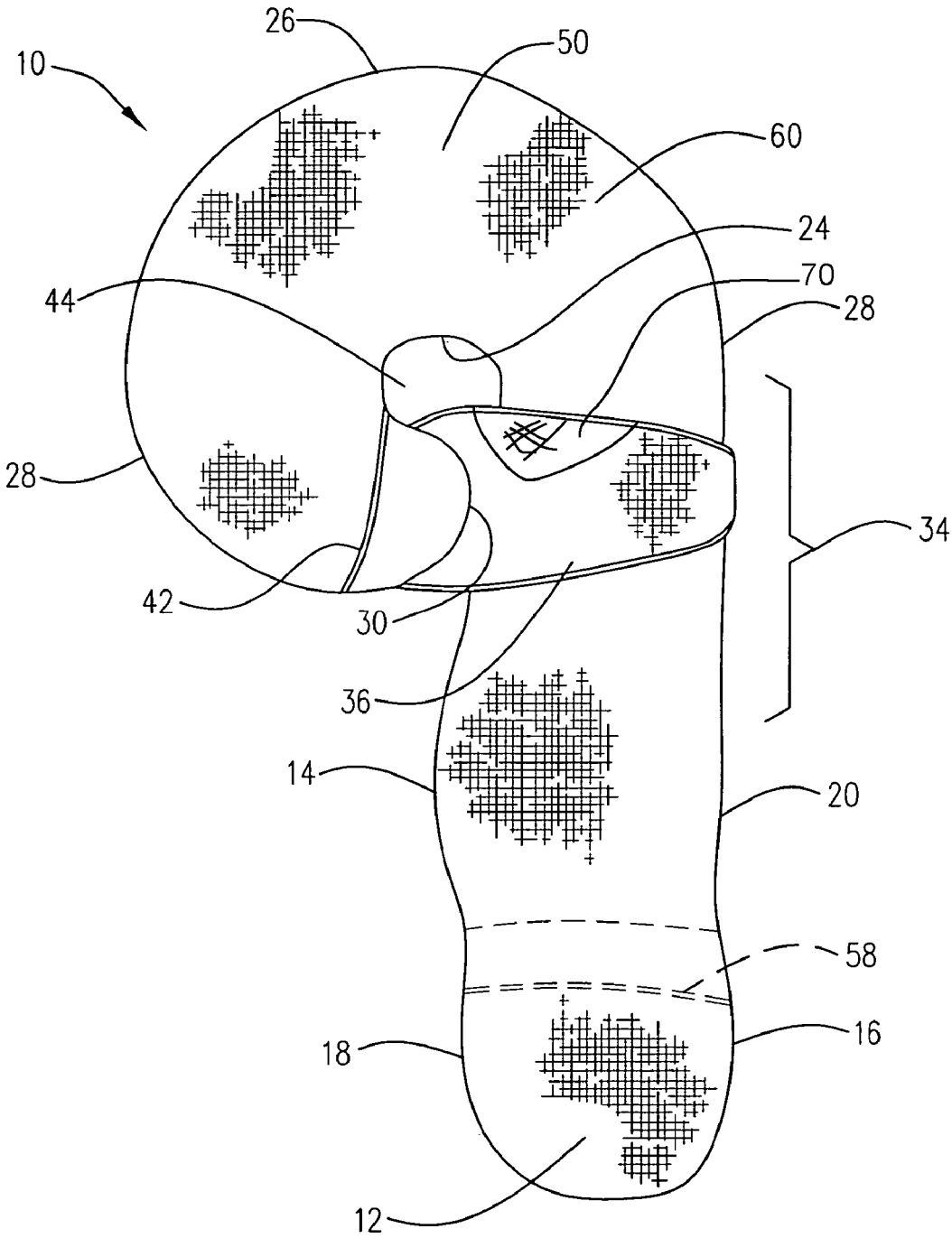
FIG. 3—Front view of the invention with the tab wrapped around the pillow structure.
Figure 4:
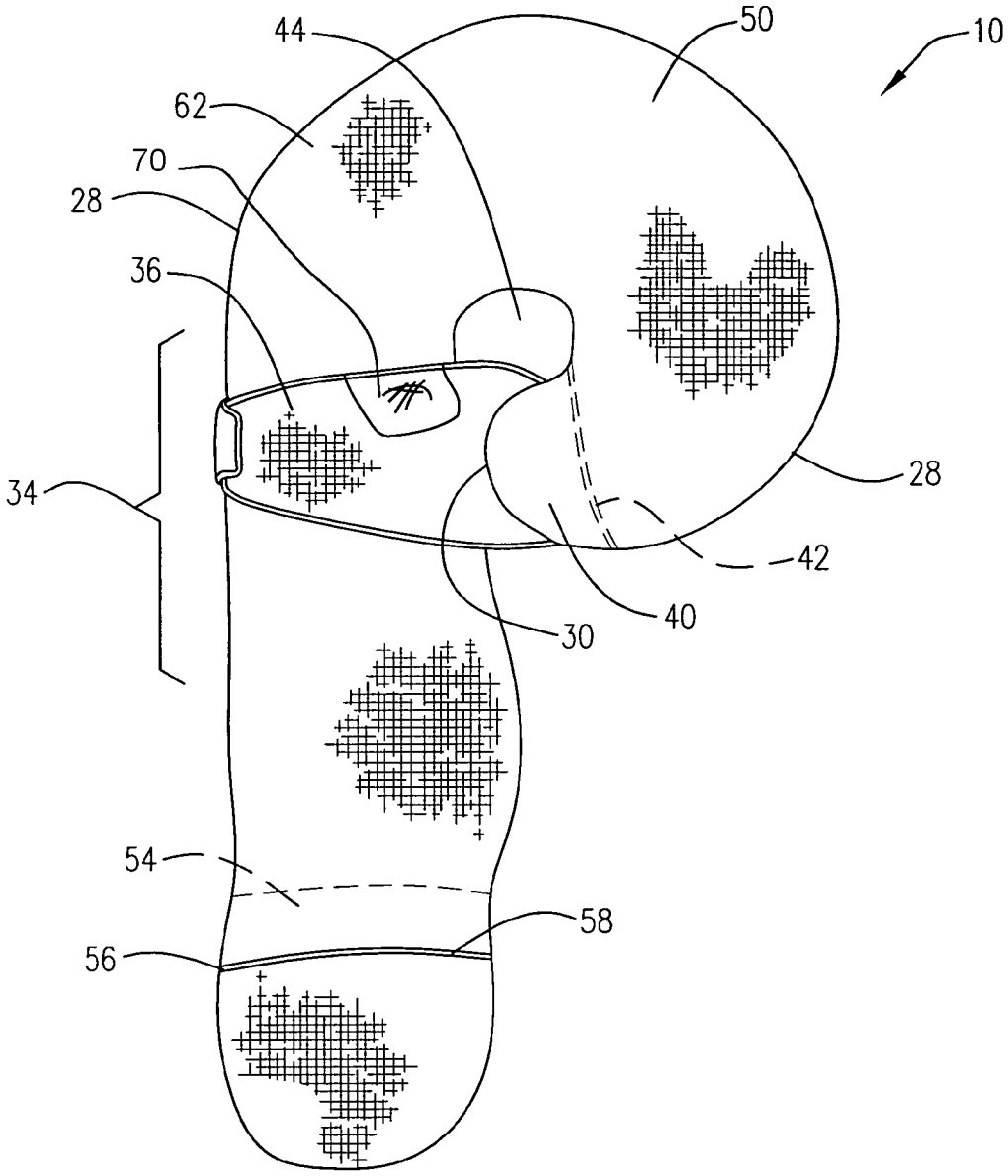
FIG. 4—Back view of the invention with the tab wrapped around the pillow structure.

With reference to FIG. 3, terminal segment 30 preferably carries at least one strap or tab 36. Preferably, tab 36 is incorporated into cover 50. Tab 36 has a length sufficient to permit wrapping around lower segment 12, transitional segment 34 or the opposite side of circular segment 28, preferably forming a loop that is slidable along the length of the lower segment 12, transitional segment 34 or the opposite side of circular segment 28. Thus, tab 36 secures terminal segment 30 to the main body of pillow 10 to form the desired circle 44.

Figure 2:
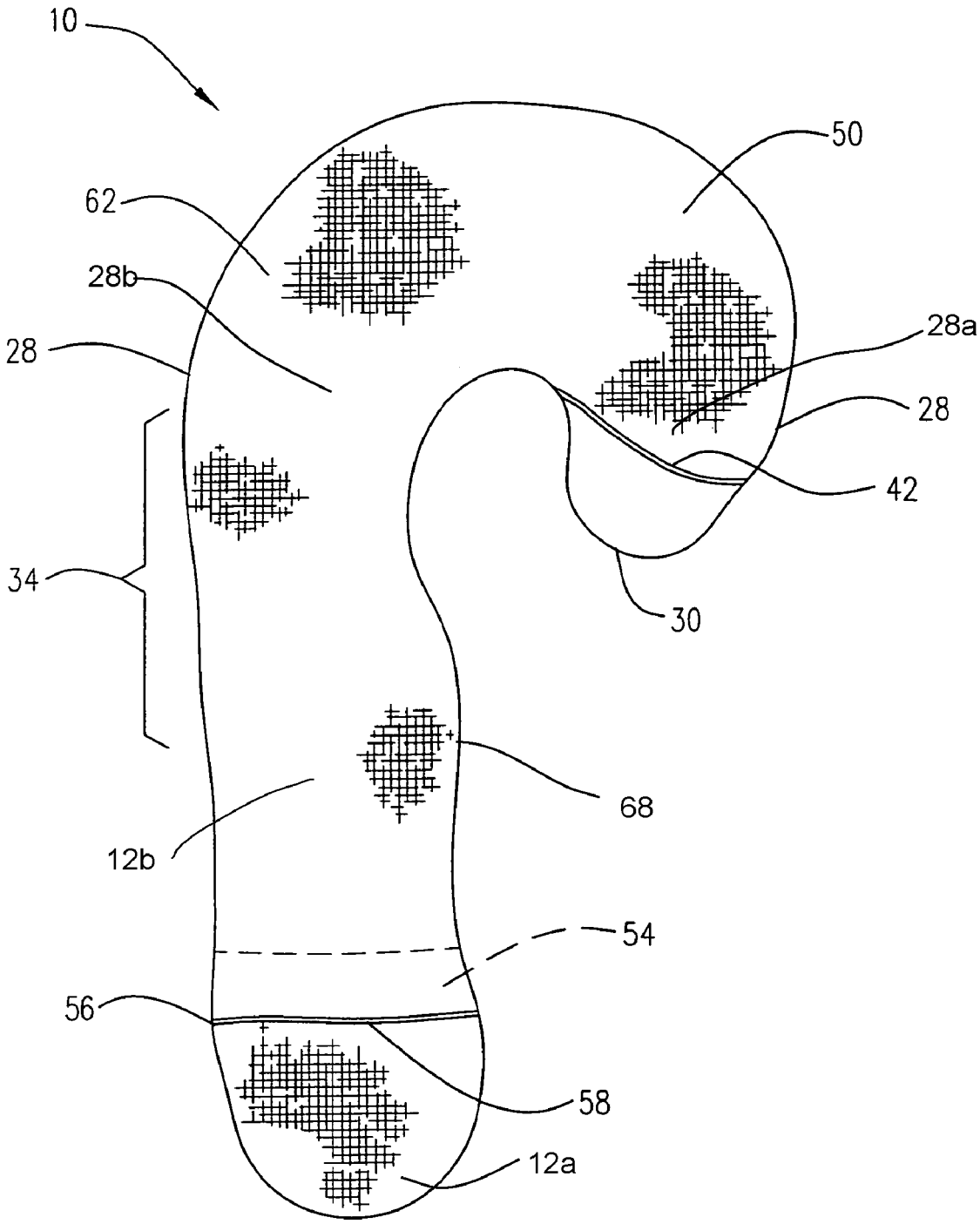
FIG. 2—Back view of invention with the tab in a stowed position.

More preferably, terminal segment 30 carries at least two tabs 36 which are stored within a pouch 40. Preferably, pouch 40 is incorporated into cover 50 in the area corresponding to terminal segment 30. FIG. 3 depicts the un-stowed position of pouch 40 and tab(s) 36. As such, when pouch 40 is pulled open it flips to front side 60 of pillow 10 and collapses into a state wherein a seam 42 is smooth against cover 50. FIG. 2 depicts pouch 40 with tab(s) 36 (not shown in FIG. 2) in the stowed configuration on a backside 62 of pillow 10. In the preferred embodiment, tabs 36 (not shown in FIG. 2) are prepared from the same material as cover 50.

To improve the comfort of pillow 10; tab(s) 36 optionally include a suitable batting material 70 thereby providing a thin layer of padding and firmness. Further, tabs(s) 36 carry connectors such as, but not limited to, hook and loop connectors, fabric ties, zippers, buttons and/or snaps suitable for securing tab(s) 36 around or to segments 12, 34 or the opposite side of segment 28. One skilled in the art will recognize that various arrangements may be provided to secure tab(s) 36 to one another or pillow 10 in a manner that will produce the desired configurations detailed herein.

Tab(s) 36 provide the user of pillow 10 with the ability to configure pillow 10 in a multitude of useful positions tailored to the user's individual needs. For example, in one configuration the user lies upon the part of the pillow where tab(s) 36 are secured about segments 12, 34 or the opposite of segment 28. In this arrangement, the user's lower arm passes through the resulting circle 44 and rests under pillow 10. Further, in this configuration, circular segment 28 combined with terminal segment 30 force the person's upper body to roll towards segments 12, 34 and the opposite side of segment 28 resulting in increased support of the abdomen while providing support to the upper back of the person. This configuration also forces inner contour 14 to be pulled into the person's abdomen thereby providing support to the abdomen by adding a slight opposing pressure or force function from inner contour 14 and the combination of segments 12, 34 and the opposite side of segment 28 to the person's abdomen, greatly increasing the overall support and comfort of the person using the invention.

The resulting pressure or force function provided by inner contour 14 is one of the distinct benefits of pillow 10. Positioning of tab(s) 36 dictates the amount of pressure or force. Placing tab(s) 36 at a higher location on segment 34 or on the opposite side of segment 28 reduces pressure brought to bear on the user's abdomen. The inverse is also true in that the lower the placement of tab(s) 36 on segment 12 or 34, the greater the pressure brought to bear on the abdomen of the user. The same effect can be created by not attaching tab(s) 36 around the pillow. This configuration places less of the pillow structure under the person using pillow 10 thereby increasing the pressure of the top portion on their upper body. Both configurations utilize segment 12 to provide support to the legs.

As discussed above, use of tab(s) 36 about segments 12, 34 and the opposite side of segment 28 forms circle 44. Note: for the purposes of this disclosure, the preferred embodiment utilizes two tabs 36 and is described herein with reference to two tabs 36. However, the current invention will also perform satisfactorily with a single tab 36 which must have a length sufficient to wrap around and attach to itself. Alternatively, single tab 36 may attach directly to pillow 10.

Adjustment of the size of circle 44 is provided by securing tabs 36 at various locations along segments 12, 34 and the opposite side of segment 28. Thus, placing tabs 36 high on segment 34 or the opposite side of circular segment 28, as shown in FIG. 3, produces a tight, small circle 44. This configuration allows more flexibility in lower segment 12 of the pillow. When tab(s) 36 are placed midway on segment 12 close to inner contour 14 a moderately sized or medium circle 44 is formed. Due to the improved abdominal support and increased comfort provided by a medium size circle 44 most users will likely place tab(s) 36 near inner contour 14. The medium circle 44 configuration reduces the flexibility of lower segment 12 and increases the force applied by lower segment 12 of pillow 10 to the user's abdomen. When tab(s) 36 are placed low on lower segment 12 of pillow 10 a wide or large circle 44 configuration is formed. Tab(s) 36 are typically placed below outer contour 16 to obtain this variant. Large circle 44 configuration places the user's abdomen inside of circle 44 with their head and shoulders. This variant allows the person to rest with nearly complete support all around the upper body while pulling lower segment 12 of the pillow in tightly to the abdomen.

Figure 5:
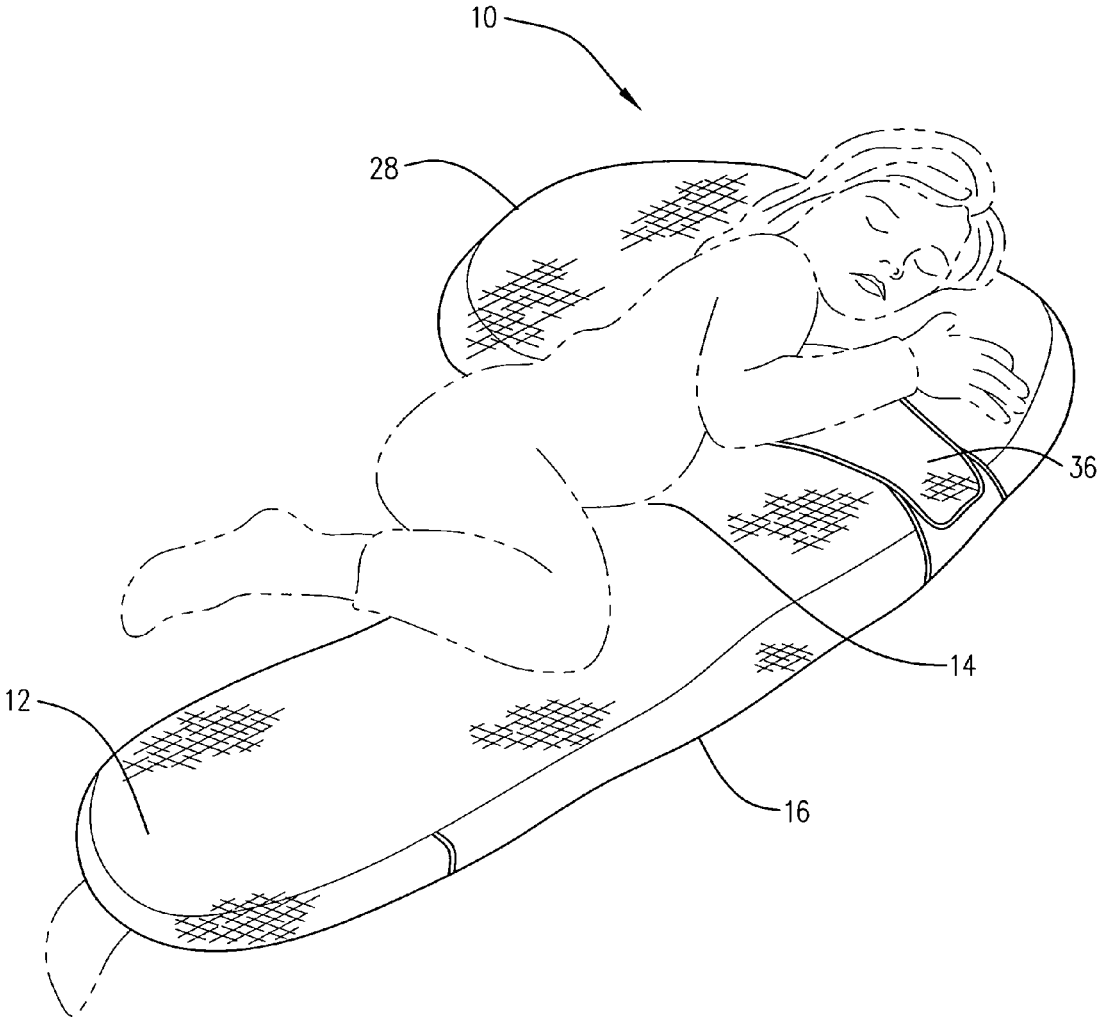
FIG. 5—Side view of the invention depicting a person using the pillow for head, abdominal and leg support.
Figure 5:
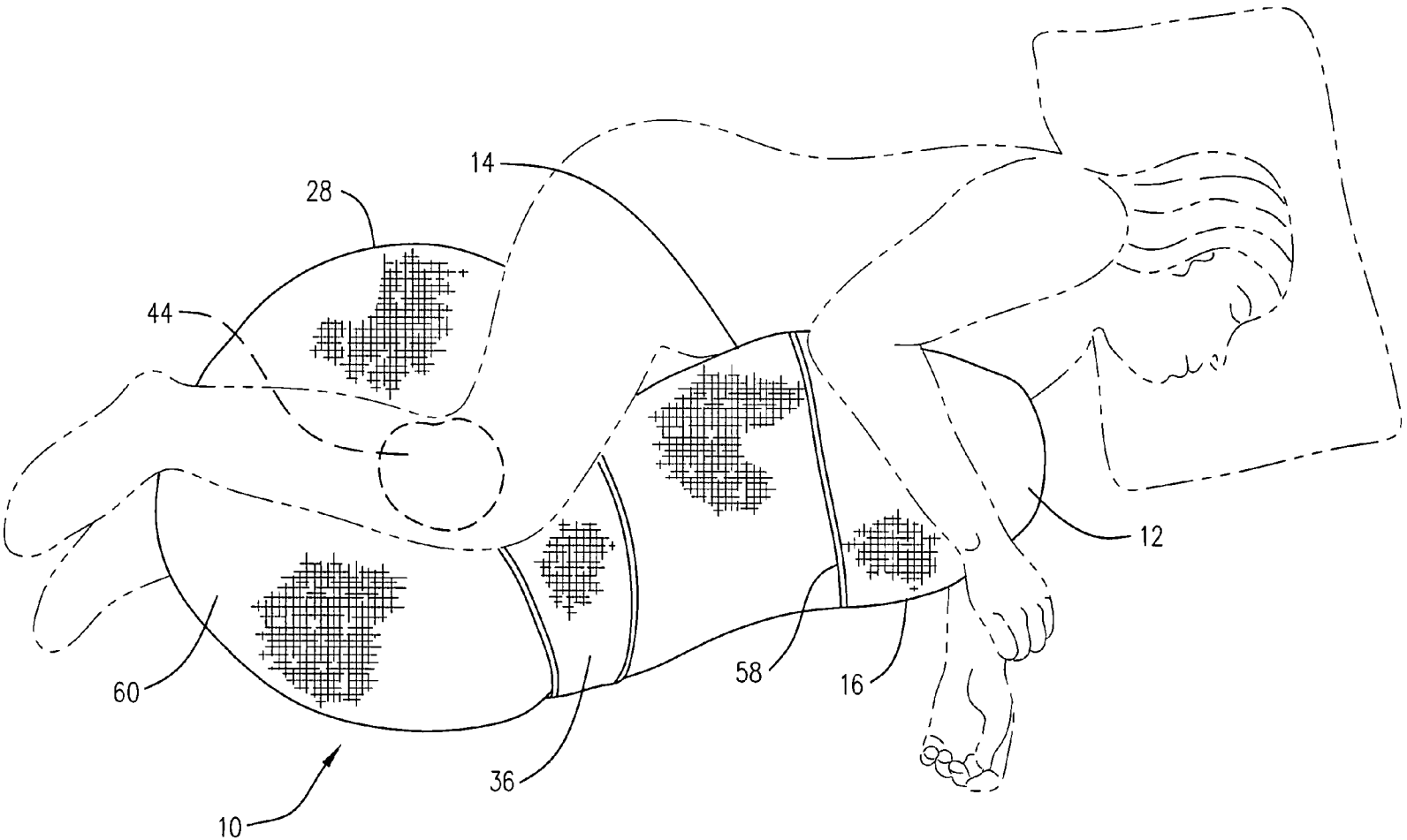

FIG. 5 depicts a person using pillow 10 to support their head, neck, abdomen and legs. In this configuration, inner contour 14 provides abdominal support while her legs are supported by lower segment 12. Using this particular configuration or similar variants, a person may alleviate the problem encountered by the pillow putting too much pressure on the person's ear. A person desiring reduced pressure on their ear employs pillow 10 as seen in FIG. 5. As depicted the head does not rest completely upon circular segment 28. Rather the person simply places the upper most part of their head on the middle of circle segment 28 thereby allowing their ear to be suspended in the well area of circle 44 thereby avoiding pressure from pillow 10 and circle segment 28. When used in this fashion, pillow 10 and circle segment 28 roll up around the edges to provide greater support for the neck area.

Figure 7:
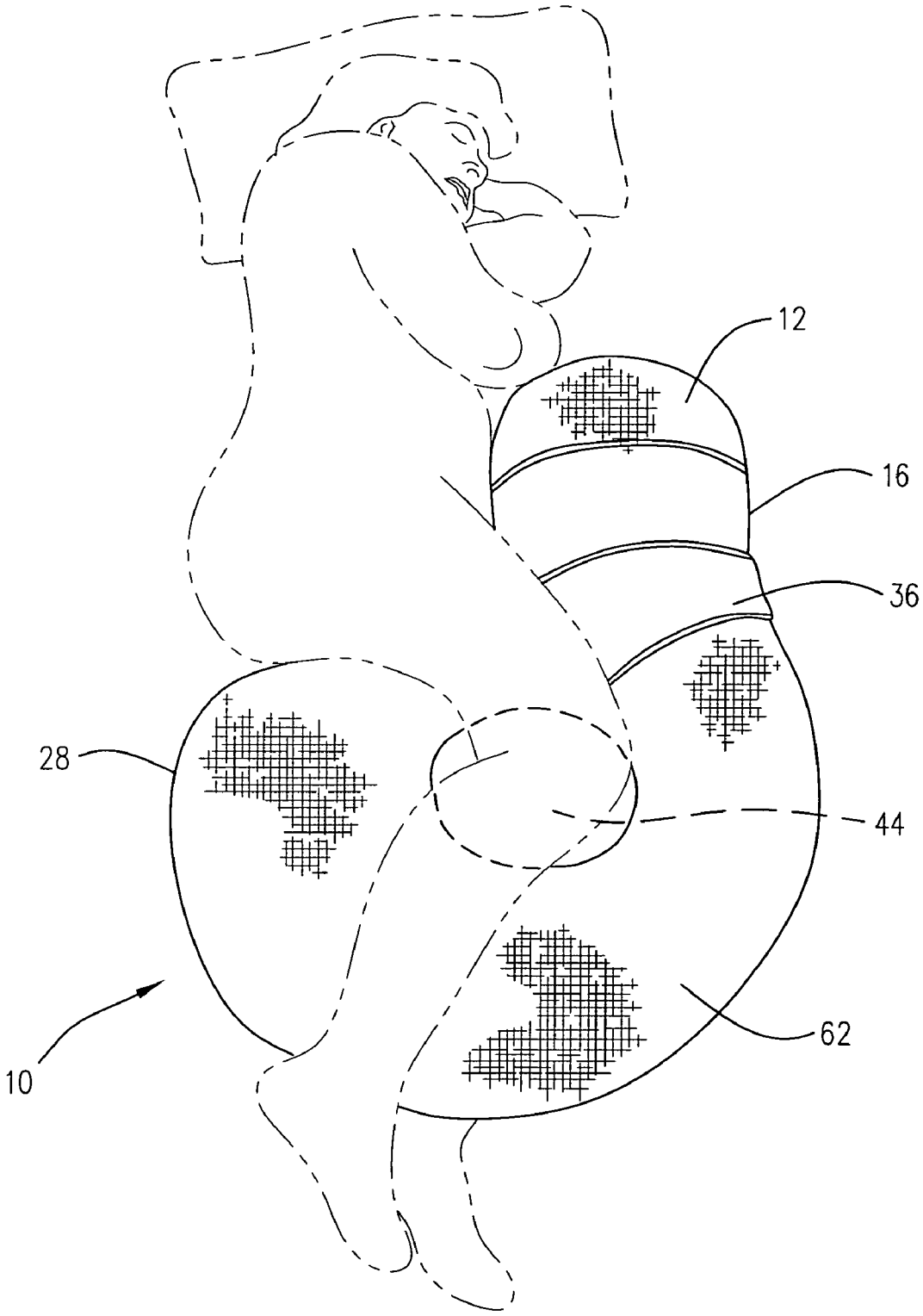
FIG. 7—Top view of the invention depicting a person using the pillow for leg support, leg ventilation and abdominal support when the pillow is configured for a large circle.

Pillow 10 of the current invention may also be used in alternative configurations. For example, FIG. 6 shows a person using pillow 10 inverted with circle 44 and segments 28 and 30 placed between their legs to provide support and ventilation. In this configuration, lower segment 12 is pulled into the body either by use of tab(s) 36 or by the person wrapping their arms around lower segment 12. When circle 44, with or without tab(s) 36, is between the person's legs, it creates an air pocket. When properly positioned, tab(s) 36 reduce the size of circle 44 thereby providing the user with improved abdominal area support resulting from tab(s) 36 increasing pressure upon the abdomen. Alternatively, repositioning tab(s) 36 as seen in FIG. 7 increases the size of circle 44, thereby providing greater ventilation for the person around and in between their legs due to a greater capacity for air to circulate. The configuration depicted in FIG. 7, supports a user's legs while allowing air circulation around the legs thereby alleviating a common problem experienced by pregnant women. Thus, FIGS. 6 and 7 demonstrate that altering the location of tab(s) 36 provides the ability to adjust the size of circle 44 and the amount of air circulation in and around the legs of the user.

It is a long-standing problem for the mother to be able to rest comfortably while nursing her new infant. This invention has solved that problem by facilitating numerous configurations where both the mother and infant are positioned in a restive state that is also secure enough to keep the infant from rolling away or being accidentally crushed by the mother. In the preferred embodiment using tab(s) 36, the mother lies on pillow 10 facing lower segment 12. She is then able to rest the infant on inner perimeter 18 of lower segment 12 such that the infant naturally rolls toward her and is able to nurse. Alternatively, the mother lies on pillow 10 with her back to lower segment 12 and the infant is cradled within circle 44.

Figure 8:
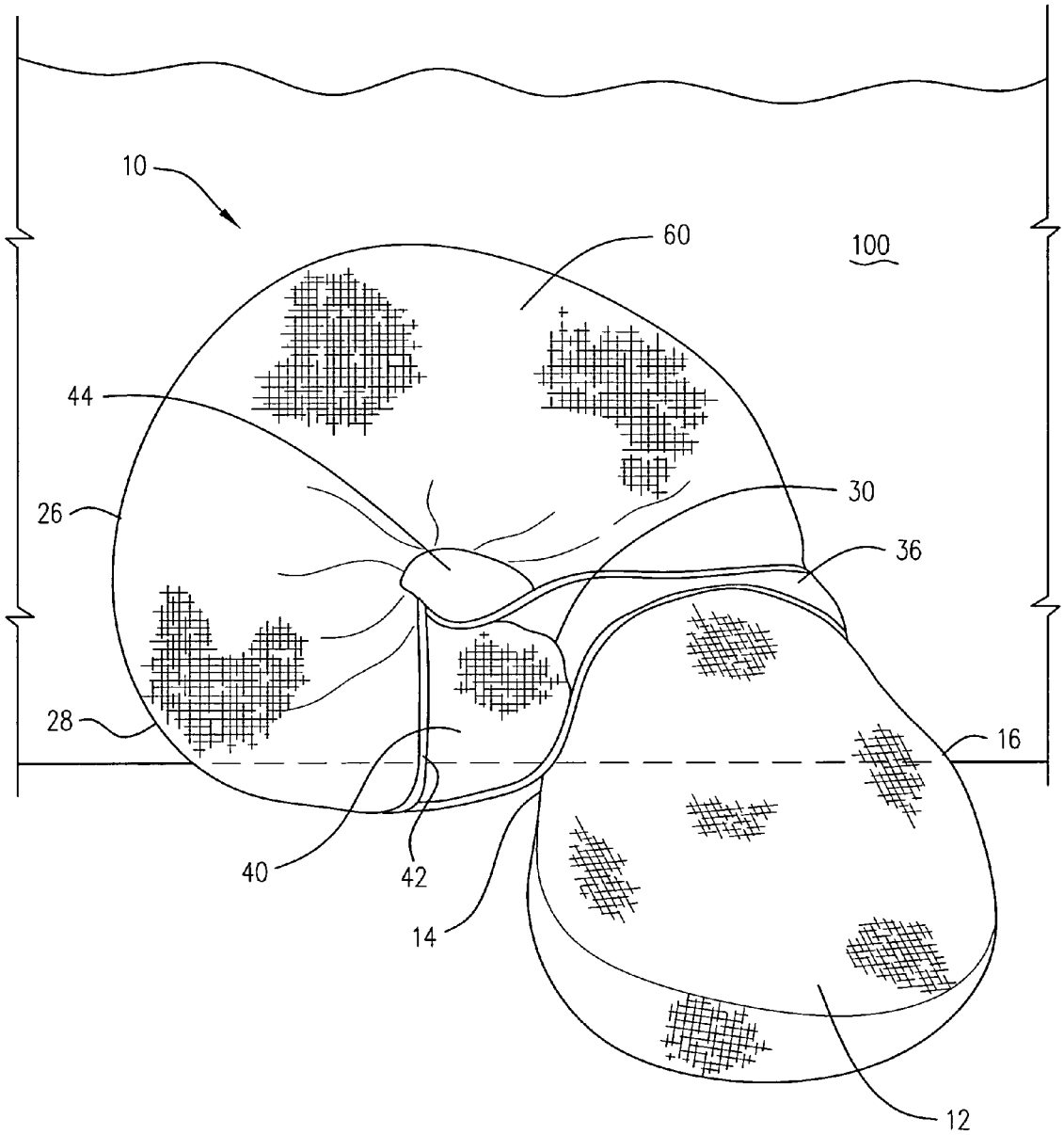
FIG. 8—Front view of the invention configured with the circle against a flat, vertical surface and the lower segment perpendicularly extending out from the flat, vertical surface by creating a bend in the pillow at the attachment point of the tab(s) along the pillow structure.
Figure 9:
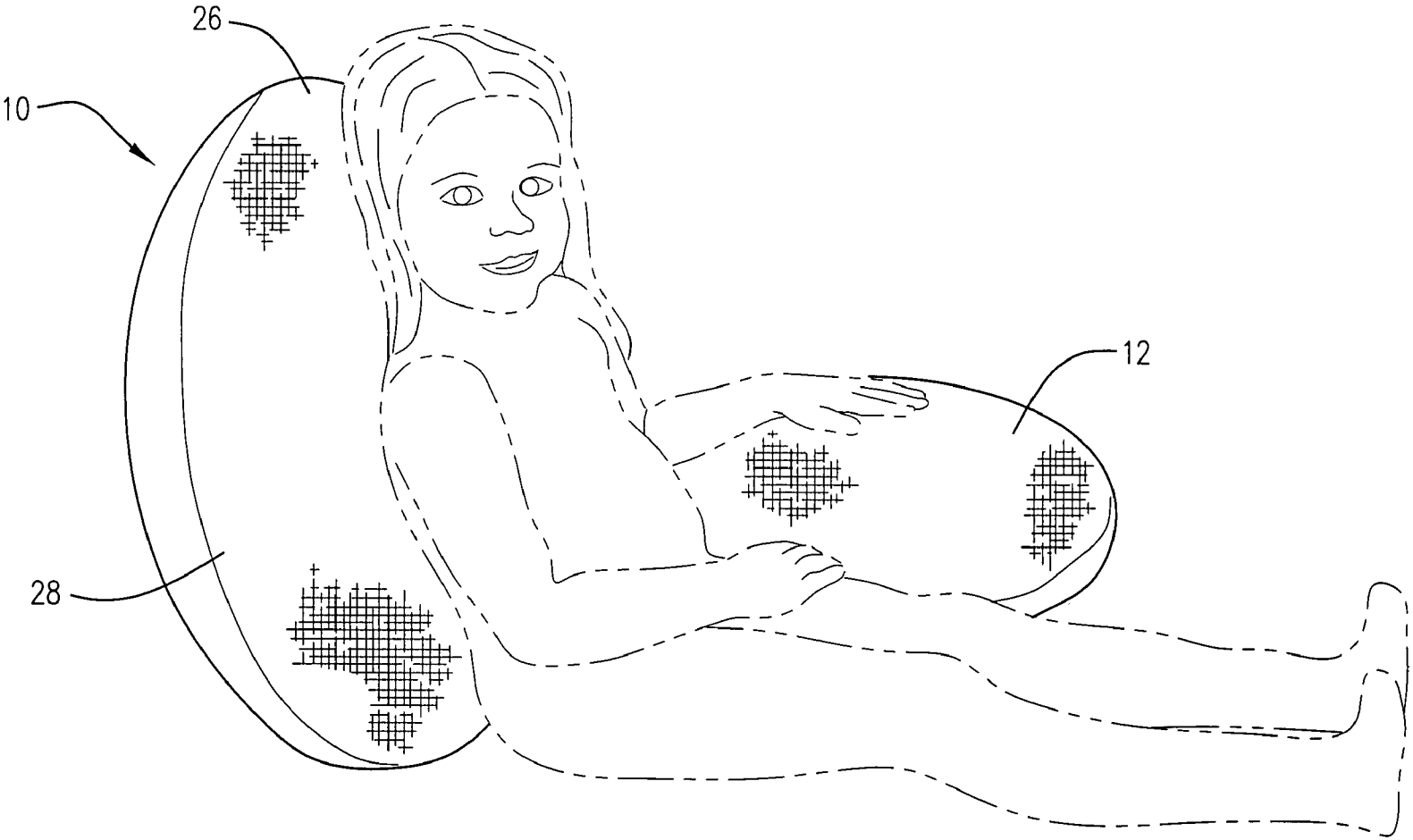
FIG. 9—Side view of the invention depicting a person using the pillow for back support and resting their arm on their left side along the lower segment of the body of the pillow.
Figure 10:
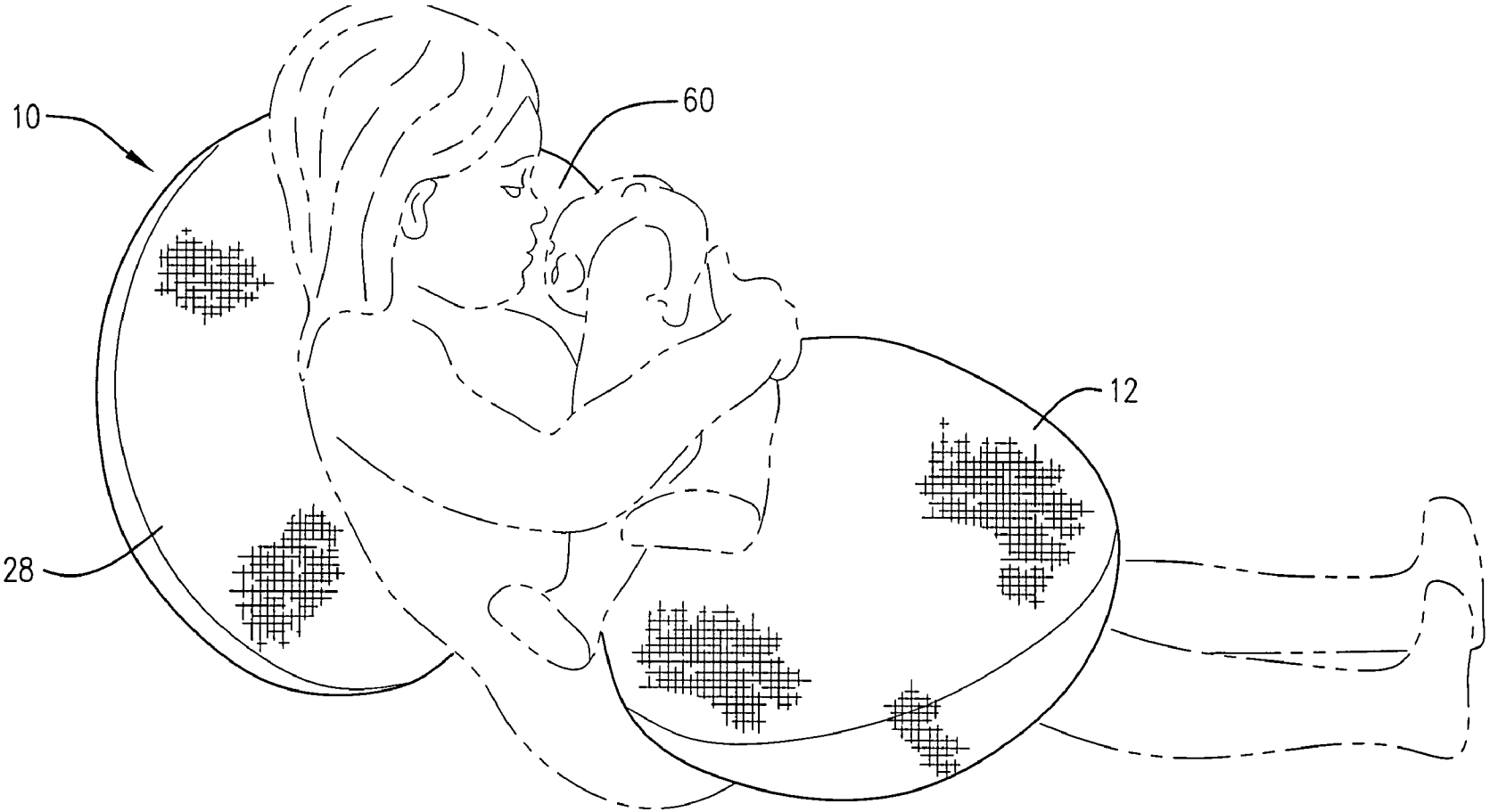
FIG. 10—Side view of the invention depicting a person using the pillow for back support and holding an infant with the lower segment pulled across the user's lap.

The invention may further be used as a nursing aid or provide support for someone in a sitting or reclining position. As seen in FIGS. 8, 9 and 10, a mother or person desiring support can place circle 44 behind their back with or without tab(s) 36 connected and lean up against a solid surface such as a wall or bed headboard. FIG. 8 shows the invention in a configuration where circle 44 is placed parallel against flat, vertical surface 100 and lower segment 12 is bent at the juncture formed when tab(s) 36 are connected to form circle 44. In this configuration lower segment 12 extends perpendicular to flat, vertical surface 100. The configuration of pillow 10 in FIG. 8 is identical to FIG. 9 except there is not a person in FIG. 8. As seen in the configuration of FIG. 9, lower segment 12 may be placed along side the body as an arm rest or, as seen in FIG. 10 lower segment 12 may be pulled across the lap of the user to provide a support area for nursing. The configuration of lower segment 12 in an arm rest configuration results in reducing pressure on the elbow, forearm and wrist thereby providing comfort to those suffering carpal tunnel syndrome or any other wrist or hand injury requiring elevation. When lower segment 12 is pulled across the lap it may also be used for any lap related activity such as reading, writing, computer use or other activity requiring support. In this configuration the user has the option of putting circle 44 partly behind them anywhere along their back, neck or head while lower segment 12 lies beside them or across their lap, depending upon whether the desire is for lower back, middle back or neck support. In alternative configuration (not shown) a mother will place lower segment 12 behind her back while leaning up against a solid surface by wrapping circle segment 28 and terminal segment 30 around her waist. Use of pillow 10 in this manner allows the mother to create a place were the infant is naturally cradled in her lap at an appropriate height for nursing. Advantageously when used in this manner, pillow 10 will roll the infant toward the mother. Additionally, lower segment 12 supports the mother's back. Proper positioning of pillow 10 will also support the mother's upper back, neck and head.

In the configurations found in FIGS. 8, 9 and 10, individuals using pillow 10 are able to obtain support for their back in the reclining or supine positions. Individuals suffering the effects of osteoporosis, acid reflux disease, respiratory ailments or other maladies whereby there is a need to rest in a sitting or reclining position, reducing back pain or easily pained back bone structures, will be able to use pillow 10 as previously described to obtain supportive relief. Circle 44 provides a well wherein the spine of the user has less pressure applied against it thereby increasing the overall comfort and support seen by the user. Support is varied for users by increasing or decreasing the size of circle 44 by moving tab(s) 36.

Pillow 10 may also be used to provide support for a person following an injury or surgery in the groin or buttocks area. Often these individuals cannot sit directly on a solid surface even if it were padded. However, when pillow 10 is configured with a tight or small circle 44 the user may sit on pillow 10 surface without placing pressure on the sensitive areas.

Still further, pillow 10 may be used to reduce pressure on the lower back while supporting the legs. In this configuration, the user places their buttocks next to pillow 10 with their legs across lower segment 12 and their feet touching the floor on the other side of lower segment 12. In this position the user's knees are bent. Alternatively, a person can use a similar approach to support the entire length of a leg by having lower segment 12 traverse the entire leg. This configuration still relieves pressure on the lower back and it reduces the pressure on the legs. This alternate configuration also provides elevation for the user's legs. Yet another configuration allows the user person to lie down with circle 44 under their legs functioning similar to when lower segment 12 is perpendicular to the legs. In still yet another configuration the person may sit in small circle 44 with lower segment 12 providing support to their legs when it is stretched out in the direction the person is facing.

Due to frequent usage pillow 10 will eventually require cleaning. Thus in a preferred embodiment, pillow cover 50 is removable to permit laundering. One embodiment providing an easily removable cover 50 is shown in FIG. 2. In this embodiment pillow cover 50 is put on and removed by opening and closing flap 54 on backside 62 of the pillow 10. Because the use of pillow 10 is for restful purposes it is important that flap 54 have a soft, durable seam 56 sewn around outer edge 58. Placement of flap 54 is shown to be high on lower segment 12 which facilitates removal and replacement of pillow cover 50 in a manner easily understood by the user of the product. Preferably, flap 54 bisects lower segment 12 from inner perimeter 18 seam to outer perimeter 20 seam with seam 56 overlapping pillow cover 50 by at least the width of the seam. In the preferred embodiment seam 56 overlaps pillow cover 50 by at least two inches. However, any flap structure or flap-like structure facilitating removal of pillow cover 50 is contemplated as part of this invention and is known to those skilled in the art.

Alternatively, pillow cover 50 may be removably secured as part of pillow 10 in lieu of flap 54 by any conventional device such as, but not limited to, a hook and loop connection or a zipper connection placed along inner perimeter 18 seam or outer perimeter 20 seam. Additionally, flap 54 may be replaced with or may include a hook and loop connection or a zipper connection. Further, flap 54 or one of the alternative connections may be located at any convenient location on pillow 10.

Although the current invention is directed towards women who are pregnant, the distinct shape of the invention and its versatility make it an ideal candidate for any user requiring support along their torso in order to achieve restful sleep. Overweight and obese people may see the same benefits as pregnant women. People with back problems may use it to lie on or to support their legs as they lay down flattening their back. Additionally individuals with severe respiratory problems frequently sleep sitting up or in a steeply vertical position would be able to employ this invention to provide comfort. It is envisioned there will be a variety of sizes of this invention to include sizes appropriate for children, small adults, medium adults and large adults.

Thus, the present invention is well adapted to carry out the objects and attain the ends and advantages mentioned as well as those inherent therein. While preferred embodiments of the present invention have been illustrated for the purpose of the present disclosure, changes in the arrangement and construction of parts and the performance of steps can be made by those skilled in the art, which changes are encompassed within the scope and spirit of the present invention as defined by the appended claims.

What is claimed is:

1. A pillow comprising:

a generally C-shaped circle segment comprising a terminal end and a nonterminal end;

a lower segment comprising a terminal end and a nonterminal end; and a transitional segment joining the nonterminal end of the lower segment to the nonterminal end of the circle segment; and a terminal segment extending from the terminal end of the circle segment;

wherein, when the pillow is in the resting position, the lower segment and the transitional segment form an elongate body extending a distance from the nonterminal end of the circle segment so that the terminal end of the lower segment is positioned further from the circle segment than the terminal segment; and at least one tab on the terminal segment, the tab comprising a loop wrapped around the elongate body of the pillow a distance above the terminal end of the lower segment to form a circle in the pillow, and wherein the loop is sized to permit adjustment of the size of the circle by moving the loop along the length of the elongate body.

2. The pillow of claim 1 wherein the at least one tab comprises two tabs including a first and second tab, each of the first and second tabs having a first end attached to the terminal segment and a second end detachably attached to the second end of the other of the first and second tabs to form the loop.

3. The pillow of claim 1 further comprising:

a form fitting cover conforming to the pillow, the form fitting cover including a terminal end corresponding to the terminal segment;

at least one pocket on the terminal end of the cover; and wherein the at least one tab is retractably received in the terminal end of the cover.

4. The pillow of claim 3 wherein the at least one tab comprises two tabs including a first and second tab, each of the first and second tabs having a first end attached to the terminal segment and a second end detachably attached to the second end of the other of the first and second tabs to form the loop.

5. The pillow of claim 3 wherein said form fitting cover is secured on said pillow by a connective device selected from the group consisting of zippers, hook and loop, buttons, snaps, overlapping segments and elements capable of being tied.

6. The pillow of claim 1 wherein the loop is slidable along the elongate body without detaching it from the elongate body.

7. The pillow of claim 6 wherein the at least one tab comprises at least two tabs including a first and second tab, each of the first and second tabs having a first end attached to the terminal segment and a second end detachably attached to the second end of the other of the first and second tabs to form the loop.

8. The pillow of claim 1 wherein each of the at least one tab comprises an upper and a lower surface with batting positioned therebetween.

9. The pillow of claim 1 further comprising an inner contour protruding from the lower segment or the transitional segment or from both the lower segment and the transitional segment.

10. The pillow of claim 9 wherein the inner contour is generally located on the inner perimeter of the lower segment.

11. The pillow of claim 9 wherein the inner contour is generally located on an inner perimeter of the lower segment and extends to at least a portion of an inner perimeter of the transitional segment.

12. The pillow of claim 9 wherein the inner contour is generally located on inner perimeters of both the lower segment and the transitional segment.

13. The pillow of claim 9 further comprising an outer contour located on the lower one-third of the lower segment.

14. The pillow of claim 1 further comprising:

an inner contour protruding from the lower segment or the transitional segment or by both the lower segment and the transitional segment; and an outer contour protruding from the lower segment.

15. The pillow of claim 14 wherein the inner contour is generally located on an inner perimeter of the lower segment.

16. The pillow of claim 14 wherein the inner contour is generally located on an inner perimeter of the lower segment and extends to at least a portion of an inner perimeter of the transitional segment.

17. The pillow of claim 14 comprising:

a form fitting cover conforming to the pillow, the cover carrying at least one pocket, and wherein the at least one tab is retractably carried in the pocket.

18. The pillow of claim 17 wherein the inner contour is generally located on inner perimeter of the lower segment.

19. The pillow of claim 17 wherein the inner contour is generally located on an inner perimeter of the lower segment and extends to at least a portion of an inner perimeter of the transitional segment.

20. The pillow of claim 17 wherein the at least one tab comprises two tabs including a first and second tab, each of the first and second tabs having a first end attached to the terminal segment and a second end detachably attached to the second end of the other of the first and second tabs to form the loop.

21. The pillow of claim 17 wherein the form fitting cover is secured on the pillow by a connective device selected from the group consisting of zippers, hook and loop, buttons, snaps, overlapping segments and elements capable of being tied.

22. The pillow of claim 21 wherein the at least one tab comprises an upper and a lower surface with batting therebetween.

23. The pillow of claim 1 further comprising an outer contour protruding from the lower segment.

24. The pillow of claim 1 wherein the loop is slidable along the elongate body without detaching it from the elongate body.

25. The pillow of claim 24 wherein the at least one tab comprises at least two tabs including a first and second tab, each of the first and second tabs having a first end attached to the terminal segment and a second end detachably attached to the second end of the other of the first and second tabs to form the loop.

* * * * *